US011150068B2

(12) United States Patent
Phillips

(10) Patent No.: US 11,150,068 B2
(45) Date of Patent: Oct. 19, 2021

(54) STEMMING PLUGS

(71) Applicant: Rise Mining Developments Pty Ltd, O'Connor (AU)

(72) Inventor: Jeffrey Bruce Phillips, O'Connor (AU)

(73) Assignee: Rise Mining Development Pty Ltd, O'Connor (AU)

( * ) Notice: Subject to any disclaimer, the term of this patent is extended or adjusted under 35 U.S.C. 154(b) by 210 days.

(21) Appl. No.: 16/348,403

(22) PCT Filed: Nov. 20, 2017

(86) PCT No.: PCT/AU2017/051270

§ 371 (c)(1),
(2) Date: May 8, 2019

(87) PCT Pub. No.: WO2018/102858

PCT Pub. Date: Jun. 14, 2018

(65) Prior Publication Data

US 2020/0072588 A1 Mar. 5, 2020

(30) Foreign Application Priority Data

Dec. 7, 2016 (AU) ..... 2016905045

(51) Int. Cl.
*F42D 1/18* (2006.01)
*F42D 3/04* (2006.01)

(52) U.S. Cl.
CPC ..... *F42D 1/18* (2013.01); *F42D 3/04* (2013.01)

(58) Field of Classification Search
CPC ..... F42D 1/00; F42D 1/08; F42D 1/18; F42D 1/22; F42D 3/00; F42D 3/04; F42D 3/06; F42D 5/06; E21B 33/12; F16B 13/0891
(Continued)

(56) References Cited

U.S. PATENT DOCUMENTS 650,803 A * 5/1900 Vesey ..... F42D 1/18 102/304
650,804 A 5/1900 Vesey
(Continued)

FOREIGN PATENT DOCUMENTS

GB 207121 11/1923
KR 1020090068697 6/2009
(Continued)

OTHER PUBLICATIONS

International Search Report and Written Opinion issued in International Application No. PCT/AU2017/051270, dated Jan. 4, 2018, 12 pages.

*Primary Examiner* — James S Bergin
(74) *Attorney, Agent, or Firm* — Hamre, Schumann, Mueller & Larson, P.C.

(57) ABSTRACT

A stemming plug (60) for stemming a blast hole in a mine is disclosed. The plug has first and second wedge-shaped members (62', 62) manufactured from a suitable plastics material. The first wedge-shaped member (62') has a first sloping face received in sliding relationship with a matching face of the second wedge-shaped member (62) wherein, in use, when the first wedge-shaped member (62') is positioned nearest to an explosive material in the blast hole it has a larger surface area facing the explosive material than the second wedge-shaped member (62). In use, when a Shock-wave from initiation of the explosive material in the blast hole encounters the first wedge-shaped member (62') it acts as a piston, sliding on the second wedge-shaped member (62) so that both wedge-shaped members exert diametrically opposed forces against the wall of the blast hole to lock the plug (60) in place. The two wedge-shaped members (62', 62) may be substantially identical, thus significantly simplifying the manufacturing process.

11 Claims, 8 Drawing Sheets

(58) Field of Classification Search
USPC ..... 102/304, 333; 299/13
See application file for complete search history.

(56) References Cited

U.S. PATENT DOCUMENTS

| | | | | |
|---|---|---|---|---|
| 1,479,070 | A | 1/1924 | Harris | |
| 1,480,894 | A * | 1/1924 | Cockburn | F42D 1/18 102/333 |
| 1,616,048 | A * | 2/1927 | Holt | F42D 1/18 102/304 |
| 2,812,712 | A | 11/1957 | Ashurst | |
| 5,936,187 | A | 8/1999 | Miller et al. | |
| 6,324,980 | B1 | 12/2001 | Bianchini | |
| 7,690,307 | B2 * | 4/2010 | Gonzalez | F42D 1/18 102/333 |
| 2008/0047455 | A1 | 2/2008 | Tota | |
| 2016/0209196 | A1 * | 7/2016 | Phillips | F42D 1/18 |

FOREIGN PATENT DOCUMENTS

| | | |
|---|---|---|
| RU | 2 329 463 | 7/2008 |
| WO | 02/090873 | 11/2002 |
| WO | 2008/075307 | 6/2008 |
| WO | 2013/170294 | 11/2013 |
| WO | 2015/035456 | 3/2015 |

* cited by examiner

STEMMING PLUGS

FIELD OF THE INVENTION

The present invention relates to mining, and relates more specifically to stemming plugs made of plastics material for blocking off mining blast holes.

BACKGROUND TO THE INVENTION

"Stemming" describes both the inert material, and the act of placing inert material into a blast hole to contain the blast gases as much as possible on detonation. Stemming relies on friction, cohesion, or bridging of the stemming material to prevent rifling out of blast holes. Without stemming, blast holes remain open and the explosives on detonation will seek the path of least resistance, being out through the open collar of the blast hole in which the explosives were placed. Resistance is desirable to make the explosives more efficient. The more resistance that can be put into a blast hole to contain the explosives, the more work the gases generated by the explosive will do in breaking the rock material around the hole on detonation.

Typically in open pit mining, blast holes are stemmed with drill cuttings. These are shoveled in on top of the explosives and the weight of those drill cuttings provides resistance to the explosives on detonation. The advantage in open pit mining is of course that the holes are vertical in a downward direction, making the act of stemming them very easy.

In contrast to this, most underground blast holes are vertical in an upward direction (termed "up holes"). Therefore stemming those holes typically either is not carried out, or is carried out by inferior products in comparison to the effectiveness of stemming open pit holes.

Some underground mines carry out benching operations which use down holes, and in some instances these holes are open at the bottom of the hole where it breaks in to existing openings. In this instance the stemming arrangement provided can also be used to stem the bottom of the hole.

Prior art approaches to stemming blast holes are all significantly different from the present invention. They primarily take the form of:

- Rubber or plastic caps that are pushed into the hole and provide very little effectiveness other than to ensure the explosives stay in the hole;
- Expansion foams, generally of a two component mix or sprayed from a can, many of which are toxic and provide little resistance in the blast hole;
- Wedge type arrangements; and,
- Inflatable sleeve (packer) configurations.

Additionally, there is the Stempac stemming plug sold through Dyno Nobel, which is inserted with an insertion tool. The Stempac plug is basically a clothing sock filled with aggregate, which is compressed by the insertion tool so that it maintains its position in the hole.

A few examples of prior art patent applications for stemming plugs are:

KR20090068697A (2007)

This Korean patent specification describes a bidirectional wedge arrangement 100 with guide wings 121. The arrangement includes a top wedge 110 and a bottom wedge 120 which are symmetrical, but face in opposite directions. The guide wings 121 are intended to centre the arrangement in the blast hole.

RU2329463 (2006)

This Russian patent specification describes a shortened monolithic stemming plug, which includes a male inner conical element made from plastic or hardboard, and is mounted with its tip facing upwards onto a bed of granulated polystyrene which fills the void between it and the explosives charge. Concrete is then poured into the collar of the blast hole around the conical element, and allowed to cure.

U.S. Pat. No. 6,324,980 (1999)

This US patent specification describes a conical plug 1 which is folded and clipped together to fit in the blast hole. A release weight 11 is then lowered down the hole which breaks the clip and causes the conical wedge to spring open and lock in the hole. It is only suitable for surface down holes.

U.S. Pat. No. 5,936,187 (1997)

This US patent specification describes a stemming plug which is cup-shaped, made out of a durable, resilient material—PVC, urethane, rubber or the like. It is designed for stemming surface down holes.

US20080047455 (2008)

This US patent specification describes a rock breaking cartridge which uses a simple wedge arrangement to self-stem, used with propellants. The only similarity is the basic wedge arrangement. It does not include any refinements that are the subject of this filing application.

The poor performance of commercially available prior art stemming plugs for up holes at present leads most mines to not stem up holes at all. This results in higher explosive use (and therefore cost), poor blast fragmentation, greater noise and vibration, increased damage to surrounding infrastructure, and less effectiveness of the explosive charge than would be the case with a suitable stemming.

PCT/AU2014/000901 (2014)

This co-pending International patent application relates to Friction-Modified Wedge Stemming Plugs in which the plug comprises an active wedge-shaped member having a sloping face received in sliding relationship with a matching face of a passive wedge-shaped member. The passive wedge-shaped member is of greater mass than the active wedge-shaped member so that, in use, the passive wedge-shaped member provides greater resistance to movement than the active wedge-shaped member. Furthermore the active wedge-shaped member is positioned nearest to an explosive material in the blast hole than the passive wedge-shaped member. The active wedge-shaped member is provided with a friction reducing material on at least part of its surface to reduce the sliding resistance of the active wedge-shaped member relative to the passive wedge-shaped member. In use, when a shockwave from initiation of the explosive material in the blast hole encounters the active wedge-shaped member it acts as a piston, sliding on the passive wedge-shaped member so that both wedge-shaped members exert diametrically opposed forces against a wall of the blast hole and are locked in place.

The stemming plug of PCT/AU2014/000901 operates quite satisfactorily in the field. However it is relatively expensive to manufacture, as it comprises a number of components that need to be prepared and assembled. The solid core of the plug, from which the wedge-shaped members are cut, is typically formed from cured grout material such as, for example, general purpose (Portland) cement reinforced with fibres for additional strength and toughness. The cured solid core then needs to be cut into the two wedge-shaped members.

The present invention was developed with a view to providing an improved stemming plug that is particularly suited for overhead blast holes (up holes) in underground mining, and which does not suffer from any of the disadvantages of the prior art noted above, and is cost-effective to manufacture. It can be more easily installed and provides greater resistance during blasting. It will be apparent that the improved stemming plug can also be used in down holes, and is not restricted to underground mining.

References to prior art in this specification are provided for illustrative purposes only and are not to be taken as an admission that such prior art is part of the common general knowledge in Australia or elsewhere.

SUMMARY OF THE INVENTION

According to a first aspect of the present invention there is provided a stemming plug for stemming a blast hole in a mine, the plug comprising:

first and second elongate wedge-shaped members manufactured from a suitable plastics material; and, the first wedge-shaped member having a larger end with a face sloping towards a smaller end, the sloping face being received in sliding relationship with a matching face of the second wedge-shaped member wherein, in use, when the first wedge-shaped member is positioned with its larger end nearest to an explosive material in the blast hole it has a larger surface area facing the explosive material than the second wedge-shaped member;

whereby, in use, when a shockwave from initiation of the explosive material in the blast hole encounters the first wedge-shaped member it acts as a piston, sliding on the second wedge-shaped member so that both wedge-shaped members exert diametrically opposed forces against the wall of the blast hole to lock the plug in place.

According to a second aspect of the present invention there is provided a stemming plug for stemming a blast hole in a mine, the plug comprising:

first and second elongate wedge-shaped members manufactured from a suitable plastics material;

the first wedge-shaped member having a larger end with a face sloping towards a smaller end, the sloping face being received in sliding relationship with a matching face of the second wedge-shaped member wherein, in use, when the larger end of the first wedge-shaped member is positioned nearest to an explosive material in the blast hole it has a larger surface area facing the explosive material than the second wedge-shaped member; and, wherein the second wedge-shaped member is provided with a retraction loop for retracting the plug from the blast hole after installation in a case of misfire;

whereby, in use, when a shockwave from initiation of the explosive material in the blast hole encounters the first wedge-shaped member it acts as a piston, sliding on the second wedge-shaped member so that both wedge-shaped members exert diametrically opposed forces against the wall of the blast hole to lock the plug in place.

Advantageously the retraction loop interferes enough with the blast hole to retain the placement of the second wedge-shaped member in the hole, and provides the frictional resistance to movement required, as well as a marginal increase in mass for the second wedge-shaped member. Preferably the retraction loop connects to a body of the second wedge-shaped member in a geometrically over-centre location, that is, when the plug is received in a blast hole, the connection points of the retraction loop on the body of the second wedge-shaped member are in the opposite half of a circumference of the hole to the main mass of the second wedge-shaped member, so that it actively pushes the wedge-shaped member into a position where it rests against the side of the hole and further allows the first wedge-shaped member to lock in place prior to initiation.

According to a third aspect of the present invention there is provided an elongate wedge-shaped member for a stemming plug used for stemming a blast hole in a mine, the wedge-shaped being manufactured from a suitable plastics material;

the wedge-shaped member having a larger end with a substantially planar face sloping towards a smaller end, the substantially planar face being adapted to be received in sliding relationship with a matching face of a substantially identical wedge-shaped member wherein, in use, two of the wedge-shaped members can be positioned in the blast hole in sliding relationship to form a stemming plug, the wedge-shaped member with its larger end nearest to an explosive material in the blast hole having a larger surface area facing the explosive material than the other wedge-shaped member;

whereby, in use, when a shockwave from initiation of the explosive material in the blast hole encounters the wedge-shaped member with its larger end nearest to the explosive material it acts as a piston, sliding on the other wedge-shaped member so that both wedge-shaped members exert diametrically opposed forces against the wall of the blast hole to lock the plug in place.

Preferably the wedge-shaped member is provided with a retraction loop for retracting the plug from the blast hole after installation. Preferably the wedge-shaped member that will have its larger end nearest to the explosive material in the blast hole has no retraction loop or the retraction loop is removed prior to installation.

Preferably the wedge-shaped member is formed with an elongate body having the substantially planar face on one side of the body and a profiled surface on the opposite side of the body which is adapted to engage with a wall of the blast hole. Advantageously the body of the wedge-shaped member is provided with a plurality of coring apertures to reduce the thickness of the plastics material in the body of the wedge-shaped member. In one embodiment the coring apertures are provided in the profiled surface.

Preferably the body of the wedge-shaped member is formed with a retention protrusion at one end and a retention ring at the other end wherein, in use, when the wedge-shaped member is brought into sliding relationship with a matching substantially identical wedge-shaped member the retention ring on one wedge-shaped member can engage with the retention protrusion on the other.

Preferably the retention protrusion also acts as a connection point for an explosives charge hose wherein, in use, two of the wedge-shaped members forming a stemming plug can be screwed onto the charge hose during installation in such a way that the wedge-shaped member with its larger end nearest to the explosive material connects to the charge hose more forcefully than the other wedge-shaped member. In this way retraction of the charge hose at an installation location will forcefully lock the two wedge-shaped members in place as the charge hose disconnects from them sequentially, first disconnecting from the other wedge-shaped member and secondly from the wedge-shaped member with its larger end nearest to the explosive material as the latter wedge-shaped member locks in the blast hole against the other wedge-shaped member.

Preferably the body of the wedge-shaped member is also provided with a detonator lead channel extending the full length of the wedge-shaped member for receiving one or two detonator leads prior to installation. Advantageously the detonator lead channel extends along an edge of the substantially planar face.

According to a fourth aspect of the present invention there is provided a stemming plug used for stemming a blast hole in a mine, the plug comprising:

a pair of substantially identical elongate wedge-shaped members manufactured from a suitable plastics material;

each wedge-shaped member having a larger end with a substantially planar face sloping towards a smaller end, the sloping face being adapted to be received in sliding relationship with a matching face of the other wedge-shaped member wherein, in use, the two wedge-shaped members can be positioned in the blast hole in sliding relationship, an active wedge-shaped member with its larger end nearest to an explosive material in the blast hole having a larger surface area facing the explosive material than the other passive wedge-shaped member;

whereby, in use, when a shockwave from initiation of the explosive material in the blast hole encounters the active wedge-shaped member it acts as a piston, sliding on the other passive wedge-shaped member so that both wedge-shaped members exert diametrically opposed forces against the wall of the blast hole to lock the plug in place.

Preferably at least one of the wedge-shaped members is provided with a retraction loop for retracting the plug from the blast hole after installation in a case of misfire. Advantageously the retraction loop interferes enough with the blast hole to retain the placement of the passive wedge-shaped member in the hole, and provides the frictional resistance to movement required, as well as a marginal increase in mass for the passive wedge-shaped member.

Preferably the retraction loop connects to a body of the wedge-shaped member in a geometrically over-centre location, that is, when the plug is received in a blast hole, the connection points of the retraction loop on a body of the passive wedge-shaped member are in the opposite half of a circumference of the hole to the main mass of the passive wedge-shaped member, so that it actively pushes the wedge-shaped member into a position where it rests against the side of the hole and further allows the active wedge-shaped member to lock in place prior to initiation.

Preferably a body of each wedge-shaped member is formed with a retention protrusion at one end, and a retention ring at the other end wherein, in use, when one wedge-shaped member is brought into sliding relationship with the other wedge-shaped member the retention ring on one wedge-shaped member can engage with the retention protrusion on the other.

Preferably a body of each wedge-shaped member is also provided with a detonator lead channel extending the full length of the body of the wedge-shaped member for receiving a detonator lead prior to installation. Typically the detonator lead channel extends along an edge of the substantially planar face of the wedge-shaped member.

Preferably each wedge-shaped member is formed with an elongate body having the substantially planar face on one side of the body and a profiled surface on the opposite side of the body which is adapted to engage with a wall of the blast hole. Advantageously the body of the wedge-shaped member is provided with a plurality of coring apertures to reduce the thickness of the plastics material in the body of the wedge-shaped member. Typically the coring apertures are provided in the profiled surface.

Advantageously the two wedge-shaped members when joined together form a near cylindrical plug with a profiled, near circular shaped spine, to best provide a contact surface for blast holes of varying diameter.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention.

BRIEF DESCRIPTION OF THE DRAWINGS

The nature of the invention will be better understood from the following detailed description of several specific embodiments of improved stemming plugs, given by way of example only, with reference to the accompanying drawings, in which.

DETAILED DESCRIPTION OF PREFERRED EMBODIMENTS

Figure 1:
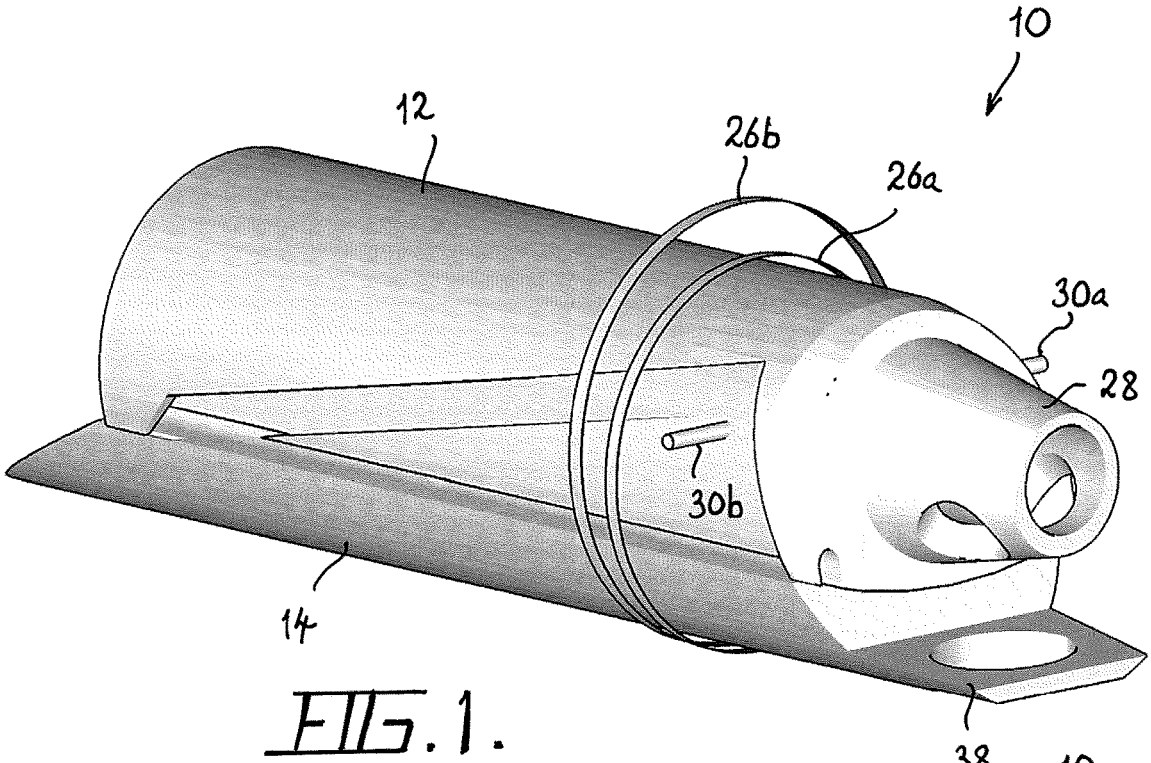
FIG. 1 illustrates a first embodiment of an improved stemming plug made from plastics material according to the present invention and shown in its installation condition.

There are a number of requirements for a practical, effective uphole stemming plug:

Firstly and most importantly, the blast hole size varies up to 10% in diameter due to the resharpening of drill button bits. This creates major challenges for blocking a blast hole with any sort of plug, and is not comparable to stemming propellants in cartridges, which have a constant diameter, nor sealing oil and gas wells which are again of a known size. It is critical that the plug must allow for a variation in size for a blast hole that is 90% to 102% of any nominal size drill hole. The actual hole size may be slightly larger than the maximum drill bit size as a result of bulling, i.e. fretting due to drill string vibration or ground conditions, rock type, etc. The plug must pass through a minimum size hole and expand out to the maximum size hole. For instance, for an 89 mm hole, the plug must pass through an 80 mm minimum size blast hole but must also be capable of filling out to the 91 mm maximum hole size.

It should preferably not have any risk of damaging the detonator lead. Preferably it should protect the detonator lead.

It should preferably allow the breathing and degassing of emulsion explosives.

It should be simple to use and place in the hole.

It should preferably not fall out on its own, particularly if other blast holes are initiated beforehand providing airblast and local, significant vibration. It should remain locked in a hole while holes are fired around it.

It should preferably be made of a material which will not build up static electricity to the point of emitting a spark.

It should preferably be easily removable in case of misfire.

It should preferably be cost effective to manufacture

It should preferably be manufactured of a material that is lightweight, durable, inert, and strong but not so strong as to create problems in downstream mine crushing and grinding equipment.

It may be self-setting or self-locking on installation; however in either instance it should work even if it is not locked in the blast hole.

To be effective, the concept follows on from a previous product which successfully blocked blast holes varying by 10% in diameter as disclosed in co-pending International Application No PCT/AU2014/000901 (Friction Modified Wedge Stemming Plugs) discussed above. That is, the plug should preferably also have the following characteristics:

A. The base of the "active" wedge should preferably have the largest surface area facing the blast. Force=Pressure× Area, so having the larger area exposed results in the larger force being on the active wedge making it piston into the "passive" wedge.

B. The greatest amount of friction should preferably be on the passive wedge.

C. The lower mass should preferably be with the active wedge (or alternatively stated the greater mass with the passive wedge). Force=Mass×Acceleration, so the wedge with the lower mass will accelerate faster than that with the greater mass.

These three factors cooperate to ensure that the wedge arrangement will lock up in the blast hole on initiation and not be ejected.

Figure 2:
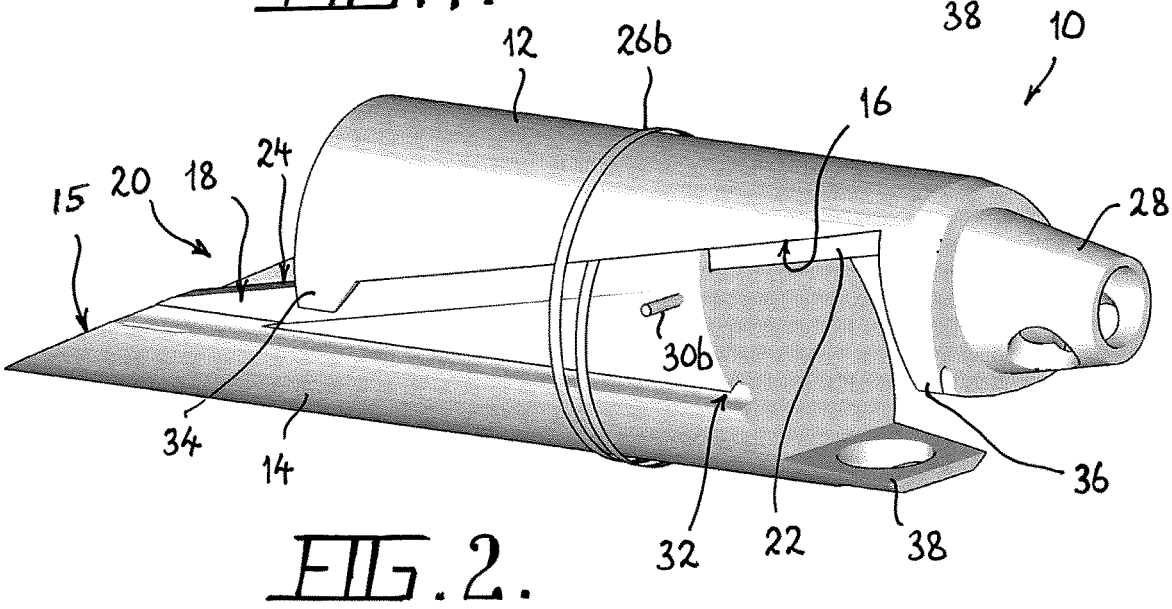
FIG. 2 illustrates the improved stemming plug of FIG. 1 shown in its locked condition.

A first embodiment of the improved stemming plug 10 for stemming a blast hole in a mine, in accordance with the invention, is illustrated in FIGS. 1 and 2. The plug 10 comprises first and second elongate wedge-shaped members 12 and 14 manufactured from a suitable plastics material. The wedge-shaped members 12, 14 are preferably made from a hard plastics material such as polyethylene, nylon, polypropylene, ABS, glass-filled nylon, or other similar materials that may be waterjet cut, machined or injection moulded. However it will be understood that the plug may be manufactured from any suitable plastics material that lends itself to mass-production.

The first wedge-shaped member 12 has a larger end with a face 16 sloping towards a smaller end, the sloping face 16 being received in sliding relationship with a matching face 18 of the second wedge-shaped member 14. In use, when the first wedge-shaped member 12 is positioned with its larger end nearest to an explosive material in the blast hole (not shown) it has a larger surface area facing the explosive material than the second wedge-shaped member 14. In use, when a shockwave from initiation of the explosive material in the blast hole encounters the first wedge-shaped member 12 it acts as a piston, sliding on the second wedge-shaped member 14 so that both wedge-shaped members exert diametrically opposed forces against the wall of the blast hole to lock the plug 10 in place.

In this embodiment the first wedge-shaped member 12 and the second wedge-shaped member 14 have an interlocking arrangement 20 provided between the first sloping face 16 and the matching face 18 wherein the interlocking arrangement 20 provides both a sliding interface and a mechanical connection between the wedge-shaped members 12, 14. In the illustrated embodiment the interlocking arrangement is a dovetail arrangement 20. That is, one of the faces in sliding relationship is formed with an elongated tongue portion 22 of wedge-shaped cross-section, and the other face is provided with an elongated groove 24 of matching cross-section in which the tongue portion 22 is slidably received.

In FIGS. 1 and 2 the two circles 26*a* and 26*b* are not part of the stemming plug. They merely indicate the range of hole sizes that the plug 10 can be used to stem. The smaller circle 26*a* shows the size of a worn drill bit. The larger circle 26*b* shows the maximum size of a new drill bit.

The second wedge-shaped member 14 has an angled base 15 which also directs the blast shock wave towards the first wedge-shaped member 12. It also translates some of the energy of the shock wave into a force that pushes the second wedge-shaped member 14 against the wall of the blast hole. The plug 10 may also be designed so that the second wedge-shaped member 14 does not extend in front of the first wedge-shaped member (piston) 12, whereby, in use, the piston base is the nearest to initiation of the explosive material. This is merely design choice dictated by manufacturing method and material volumes.

The plug 10 may be installed in the blast hole by an explosives loading hose (not shown). Preferably the upper, active first wedge-shaped member 12 of the plug, which acts as a piston, has a tapered connection 28 provided at a back end, which is sized to allow the explosives loading hose to make an interference fit with it. When the plug is in position, the hose is retracted which slides the first wedge-shaped member 12 back toward the collar of the hole and locks it in place against the second wedge-shaped member 14.

To ensure the whole plug 10 does not slide, the second wedge-shaped member 14 preferably has some friction increasing "feelers" 30*a* and 30*b* on each side, providing frictional contact for the hole for all possible hole diameters. The "feelers" 30 project from each side of the second wedge-shaped member a sufficient distance to engage with the wall of the blast hole. They are of a size and thickness so that they bend to accommodate different size blast holes. The frictional contact is 'over-centre', meaning it pushes the wedge-shaped member 14 back against the wall of the blast hole, bearing in mind the wedge-shaped members can never be a neat fit due to the variation in diameter of the drill hole.

Advantageously the second wedge-shaped member has a channel 32 for receiving a detonator lead. The first wedge-shaped member may have a "front gate" 34, and a "rear gate" 36 provided on it to retain the detonator lead in the channel 32 during the installation process. Prior to installation, the piston (first wedge-shaped member 12) is slid along the bottom, second wedge-shaped member 14 to open the gate 34, the detonator lead is placed in the channel 32, and the piston is slid back into the installation position to close the gates 34 and 36 and contain the lead. This arrangement protects the detonator lead in the channel 32.

Preferably the following characteristics of the stemming plug 10 apply:

The second wedge-shaped member 14 has a higher frictional resistance to sliding than the first wedge-shaped member 12, based on surface roughness on the spine of that member. If the plug 10 is manufactured using an injection moulding technique, it will be advantageous for coring to occur from that contacting spine area of the second wedge-shaped member 14, leaving the contacting spine ribbed (not shown). The "feelers" 30 on the second wedge-shaped member 14 also assist with installation by increasing the frictional contact between that member and the blast hole which may vary in diameter. In comparison the first wedge-shaped member (piston) 12 will have a smooth spine to reduce friction.

The first wedge-shaped member (piston) 12 has the largest surface area, being the base of that component, facing the initiation of the explosive material.

The first wedge-shaped member 12 preferably has less mass than the second wedge-shaped member 14. This could be a combination of material choice (lower SG material), cavity design, e.g. coring for injection moulding manufacture, and the volume of the component. Since Force=Mass×Acceleration, acceleration will be greater for a lighter object subject to the same force as a heavier object.

There is a retraction loop 38 preferably provided at the rear end of the second wedge-shaped member 14 for retraction in the event of a misfire.

Following testing of the first (prototype) embodiment, it is apparent that there is an advantage in combining the frictional interaction with a retraction arrangement. That is, the retraction arrangement may, for instance, be a loop that also interacts with the hole to provide frictional resistance to movement. The wedge-shaped member, particularly the lower passive wedge, may be constructed of two differing materials. For instance, the body of the lower wedge may be made of a hard, strong plastic with a thin skin of soft material and a high friction coefficient.

However, the dovetail arrangement between the two wedge-shaped members makes the plug 10 difficult to manufacture at a reasonable cost. CNC machining requires material of twice the length so that each length is machined into each wedge-shaped member, producing a lot of wastage. Injection moulding does not allow the easy manufacture of the dovetail sliding connection in either of the components.

This led to the prototype undergoing a "design for manufacture" process. There were a number of options here, and many of the manufacturing requirements contradict design requirements, requiring a trade-off of features to ensure a cost effective yet still operationally effective product:

a. CNC machining—makes it possible to manufacture almost any design, however the disadvantage for these designs is that it will be a high cost of manufacture option with high wastage.

b. Waterjet cutting—it is possible to machine the body of a plug in such a way that a thin waterjet can then cut that body into the two components, forming the wedge arrangement.

c. Injection moulding—is the preferred method of manufacture for volume and cost effectiveness, however there are some design guidelines that need to be adhered to for a successful outcome;

i. Moulding costs may be high, particularly if the moulds are complex and/or need modifying part way through the mould life (which varies depending on which mould material and injection material is used).

ii. The lower the number of moulds required the lower the cost.

iii. Injection moulded objects need to be "cored", that is, they cannot contain solid sections greater than say 4-5 mm, although this does vary significantly depending on material used and cooling time requirements driven by machine usage time=cost.

iv. Cored objects will not be as strong as solid counterparts. Ways to improve the strength of thinner sections include using higher strength materials and/or fibre reinforced plastics materials.

Figure 3:
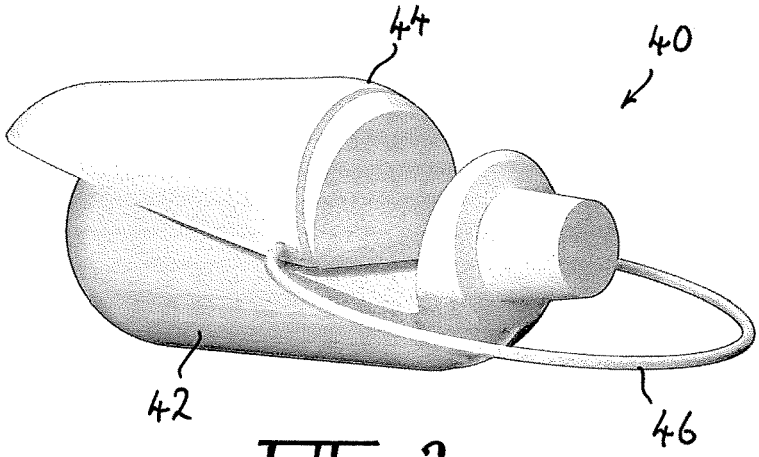
FIG. 3 illustrates a second embodiment of an improved stemming plug made from plastics material according to the present invention and shown in its locked condition.

A second embodiment of the improved stemming plug 40 for stemming a blast hole in a mine, in accordance with the invention, is illustrated in FIG. 3. The plug 40 comprises first and second wedge-shaped members 42 and 44 manufactured from a suitable plastics material.

The plug 40 can be manufactured with a waterjet cut, with a retraction loop 46 added for (1) retracting the plug 40 from the blast hole after installation; (2) positioning the second wedge-shaped member 44 flush against the hole by being over-centre; and, (3) providing some friction for initial engagement. The previous dovetail arrangement has been replaced with a flat sliding bed, which is easier to manufacture although does not keep the two components aligned. Keeping the components aligned is not necessary during and after installation, because the blast hole does this.

Waterjet cutting has the advantage of less wastage of material than CNC machining, since the two components may be cut from the one piece of material. However, some type of retention system is important for handling by the operators before use. A further disadvantage is the retraction loop 46 would need to be added to the second wedge-shaped member 44 as a separate manufacturing step.

Figure 4:
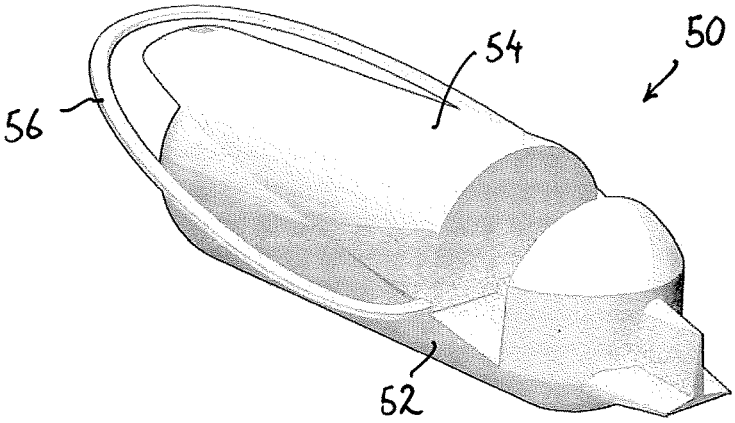
FIGS. 4 and 5 illustrate a third embodiment of an improved stemming plug according to the present invention which can be made using injection moulding to manufacture the two wedge-shaped members.
Figure 5:
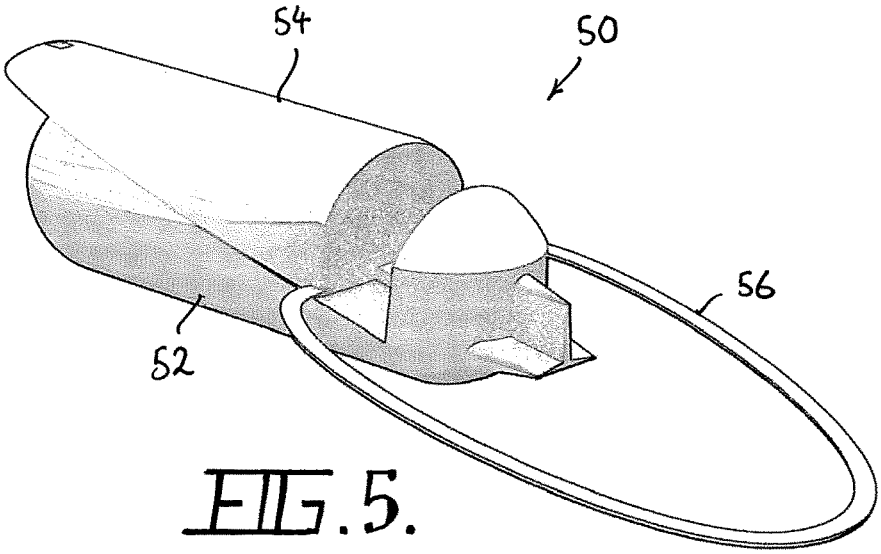

Alternatively, the plug can be manufactured using injection moulding. A third embodiment of the improved stemming plug 50 for stemming a blast hole in a mine, in accordance with the invention, is illustrated in FIGS. 4 and 5. The plug 50 comprises first and second wedge-shaped members 52 and 54 manufactured from an injection moulded plastics material. In this case the injection moulded second wedge-shaped member 54 may be made in a compact form, with a retraction loop 56 formed around the perimeter of a body of the second wedge-shaped member. In use, the loop 56 is folded back behind the wedge-shaped member to provide the full functionality of the loop (as shown in FIG. 5). The body of the plug is injection moulded with a separate mould. The plug still provides all of the features of retractability in case of misfire, and can be made to include a detonating lead channel, although this is not shown.

It is possible to further modify the design concepts described above for a more streamlined manufacturing process, with little or no deviation from the key design concepts. The move to a flat sliding bed frees up manufacturing options, however the plug does need some retention of components to ensure ease of handling.

Up to this point the design has focused on two components. However, streamlining manufacturing can be taken further by reducing this to one simple component for manufacture. A component that can be doubled-up with a second version of itself, and combined to provide a simple to use plug with all of the above features, and that is easy and cost effective to manufacture, from a variety of materials such as nylon, polyethylene, ABS, glass filled nylon, etc.

Figure 6:
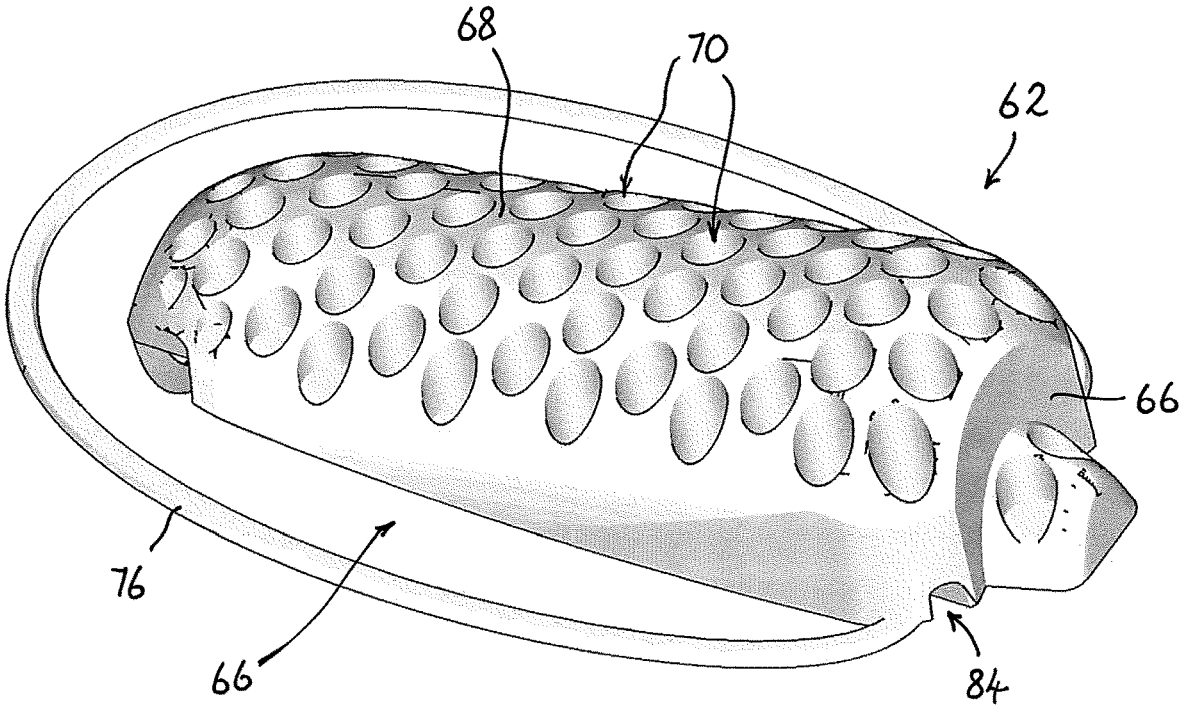
FIG. 6 illustrates a wedge-shaped member made from plastics material for a fourth embodiment of an improved stemming plug according to the present invention, shown in top perspective view.
Figure 7:
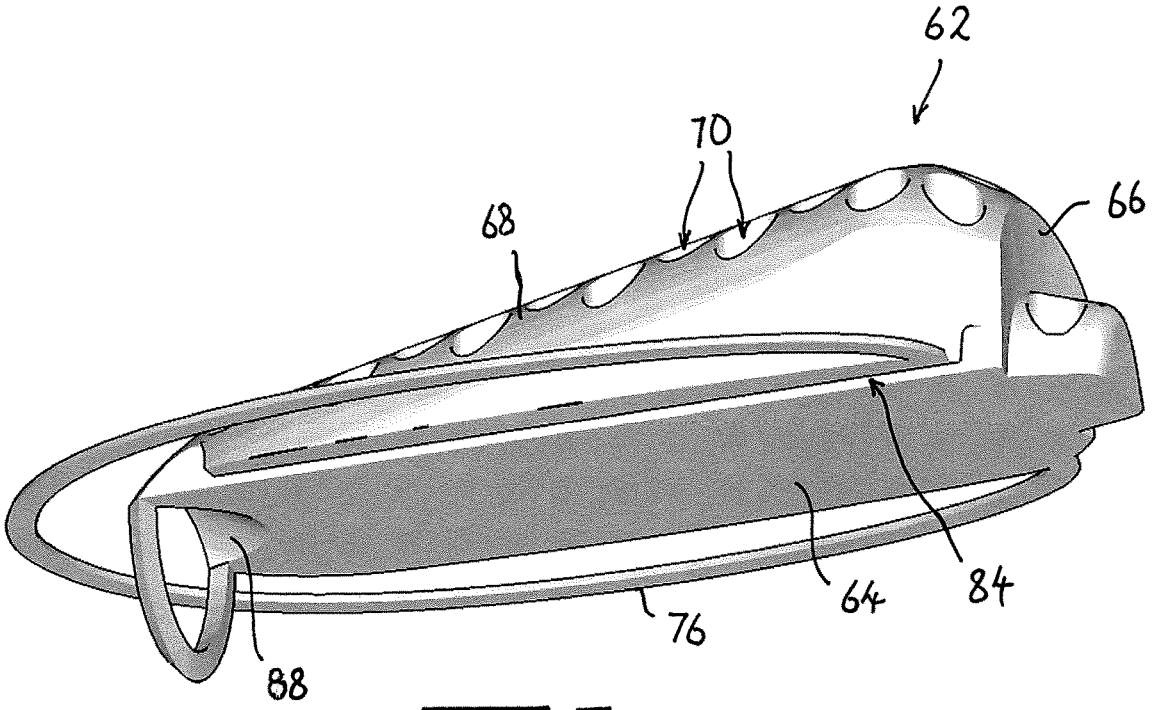
FIG. 7 illustrates the wedge-shaped member of FIG. 6 in bottom perspective view.

A fourth embodiment of the improved stemming plug 60 for stemming a blast hole in a mine, in accordance with the invention, is illustrated in FIGS. 6 to 18. In this embodiment the plug 60 comprises a pair of elongate wedge-shaped members 62 that are substantially identical and manufactured from a suitable plastics material. FIGS. 6 and 7 illustrate a preferred embodiment of a wedge-shaped member 62. Each wedge-shaped member 62 has a larger end with a substantially planar face 64 sloping towards a smaller end, the substantially planar face 64 being adapted to be received in sliding relationship with a matching face 64' of another wedge-shaped member 62'. In use, the two wedge-shaped members 62 can be positioned in the blast hole in sliding relationship, the wedge-shaped member 62' with its larger end nearest to an explosive material in the blast hole having a larger surface area facing the explosive material than the other wedge-shaped member.

In use, when a shockwave from initiation of the explosive material in the blast hole encounters the wedge-shaped member 62' with a larger surface area facing the explosive material it acts as a piston, sliding on the other wedge-shaped member 62 so that both wedge-shaped members exert diametrically opposed forces against the wall of the blast hole to lock the plug 60 in place.

Injection moulding requires a parting plane and specific draft angles from that plane to allow a finished item to be ejected quickly from the mould. While there are a number of ways of doing this, inevitably this does impact some parts of the design. Nevertheless, the design can satisfy these requirements and arrive at a plug 60 assembled from two of the same components 62.

Preferably the wedge-shaped member 62 is formed with an elongate body having the substantially planar face 64 on one side of the body and a profiled surface 68 on the opposite side of the body which is adapted to engage with a wall of the blast hole. Advantageously the body of the wedge-shaped member 62 is provided with a plurality of coring apertures 70 to reduce the thickness of the plastics material in the body of the wedge-shaped member 62.

In the illustrated embodiment the coring apertures 70 are provided in the profiled surface 68. However coring could also be carried out from the inside of the wedge-shaped member 62, i.e. in the substantially planar face 64 leaving the profiled surface 68 with less edges to catch on loose rocks during installation. The trade-off is a cored sliding surface may not stay as flat as it otherwise would when load from the blast comes on to the plug, and the smooth profiled surface may not grip the walls of the hole as well as it otherwise would.

Figure 16:
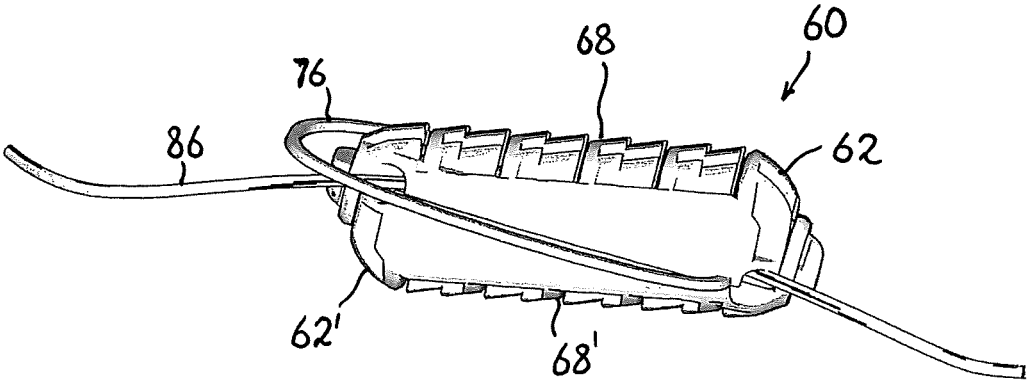
FIG. 16 illustrates the stemming plug of FIG. 15 in side elevation.
Figure 17:
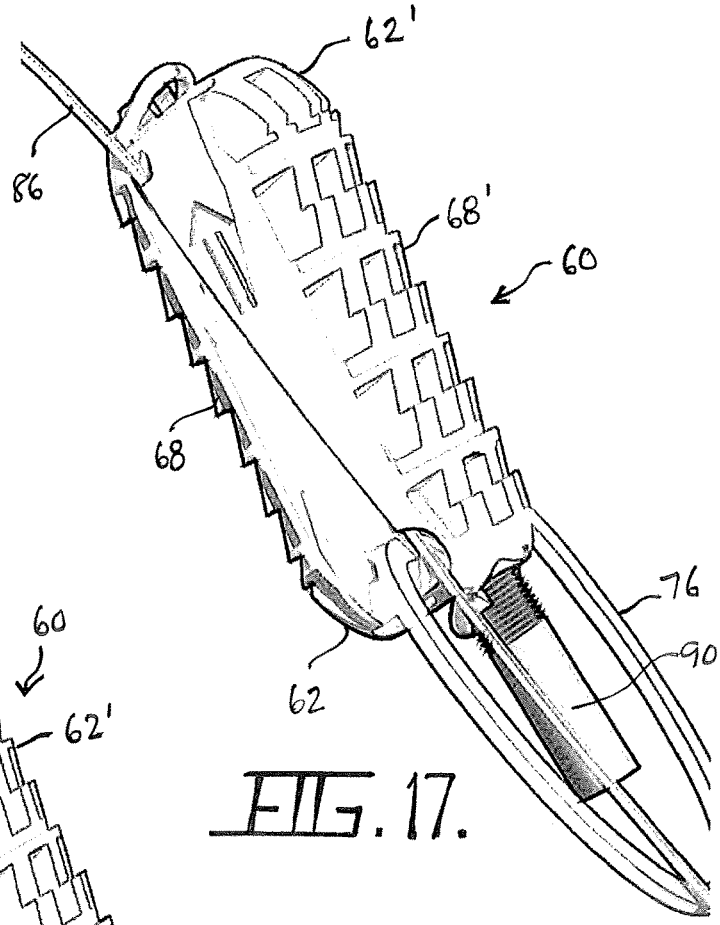
FIGS. 17 and 18 illustrate a preferred method of installing the stemming plug of FIG. 16 in a blast hole; and, FIG. 19 illustrates a preferred embodiment of a retraction hook that can be used for retracting the stemming plug of FIG. 16 from the blast hole in case of misfire.
Figure 18:
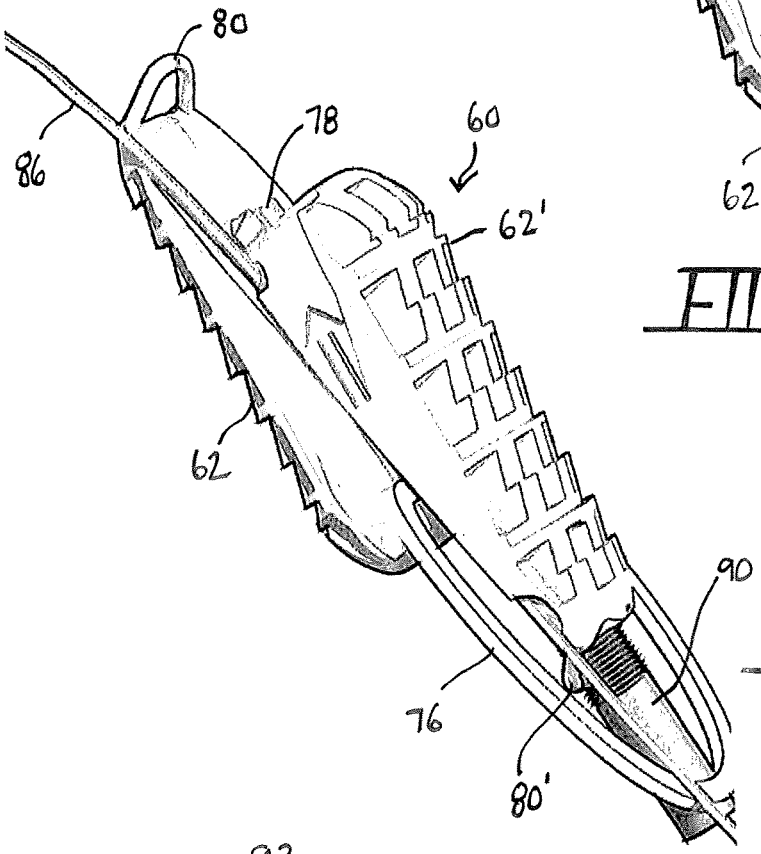

There is also an advantage in having a serrated profiled surface 68 with directional serrations, as shown in FIGS. 16 to 18. In this case, the active wedge-shaped member 62' (piston) travels forward with the serrations on initiation, and therefore has less resistance, whereas the passive wedge-shaped member 62 is forced backwards against the serrations and therefore has relatively more frictional resistance. All of these considerations will be field-tested to determine the best result.

Preferably the wedge-shaped member 62 is also provided with a retraction loop 76 for retracting the plug 60 from the blast hole after installation in case of a misfire. When two such components are combined, the active wedge-shaped member 62' has a superfluous retraction loop 76' on it which can be cut off and recycled, leaving only the passive wedge-shaped member 62 with a retraction loop 76. The retraction loop 76 provides frictional resistance to movement for the passive wedge-shaped member 62 and also a marginal increase in mass.

Preferably the active wedge-shaped member 62' that will have the larger surface area facing the explosive material in the blast hole, has the retraction loop 76' removed prior to installation. Alternatively, in some circumstances, the loop 76' on the active wedge-shaped member 62' may be left on. It may, for instance, assist in placement of the plug 60 when pushed down a breakthrough hole to stem the bottom of a charge with the explosives placed on top of the plug.

Figure 8:
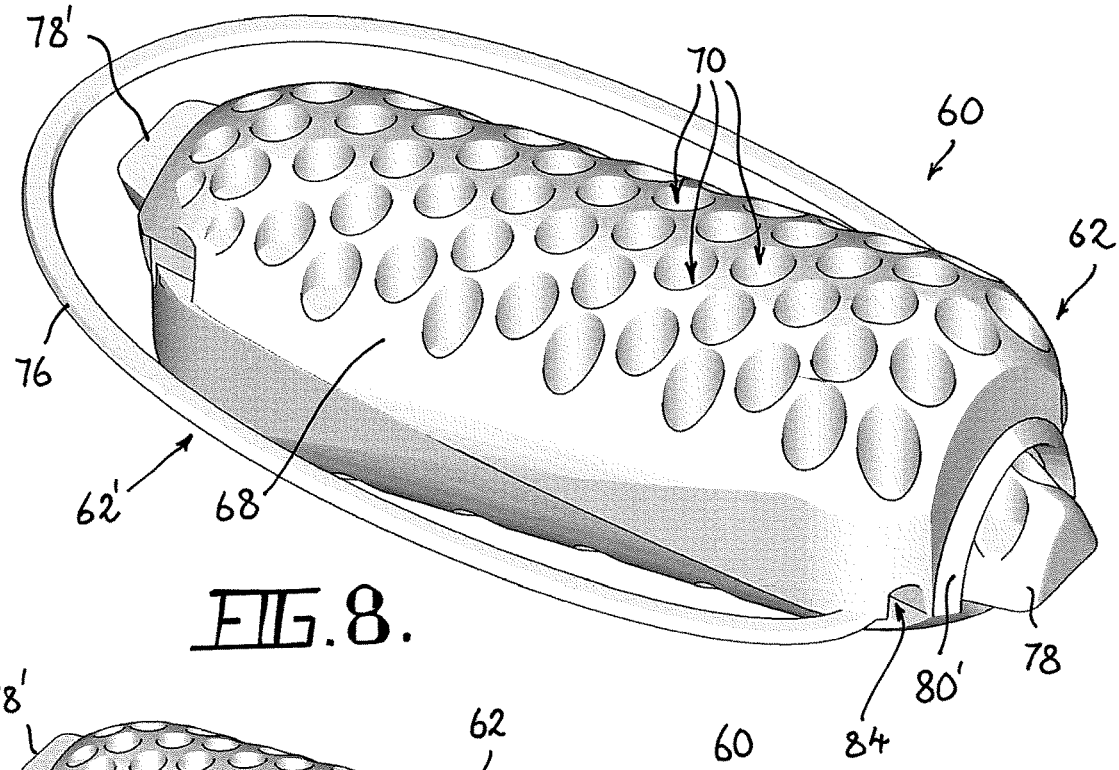
FIG. 8 illustrates the wedge-shaped member of FIG. 6 in sliding relationship with a substantially identical wedge-shaped member to form a stemming plug shown in an installation condition.
Figure 9:
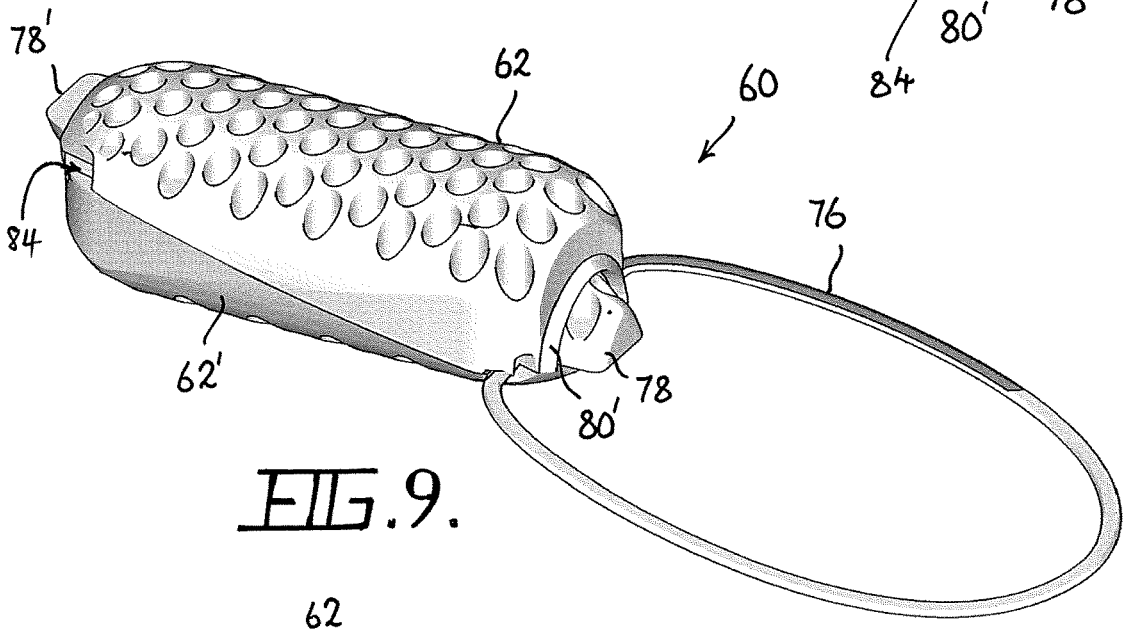
FIG. 9 illustrates the stemming plug of FIG. 8 with the retraction loop folded so that it faces rearward.
Figure 10:
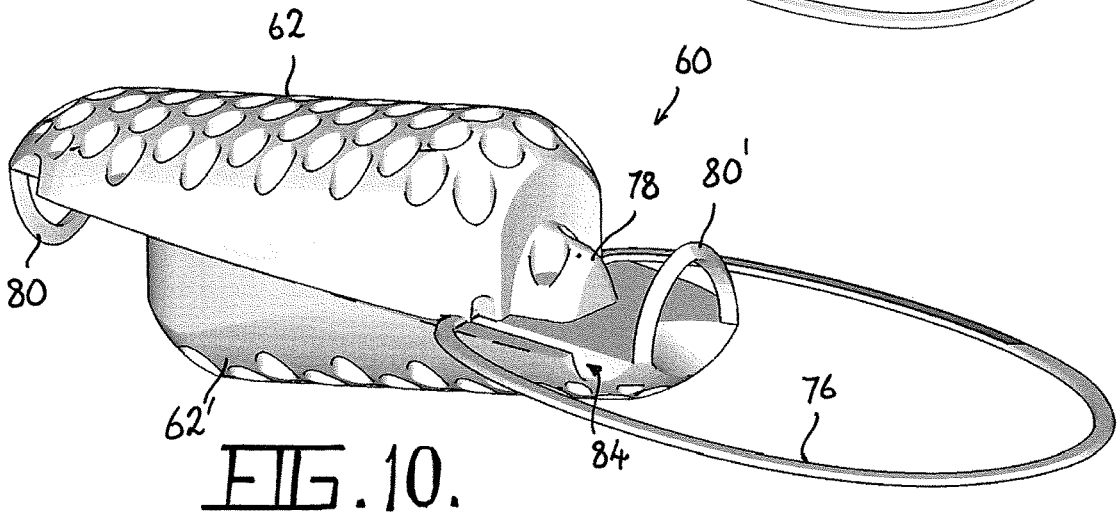
FIG. 10 illustrates the stemming plug of FIG. 8 in a locked condition.
Figure 11:
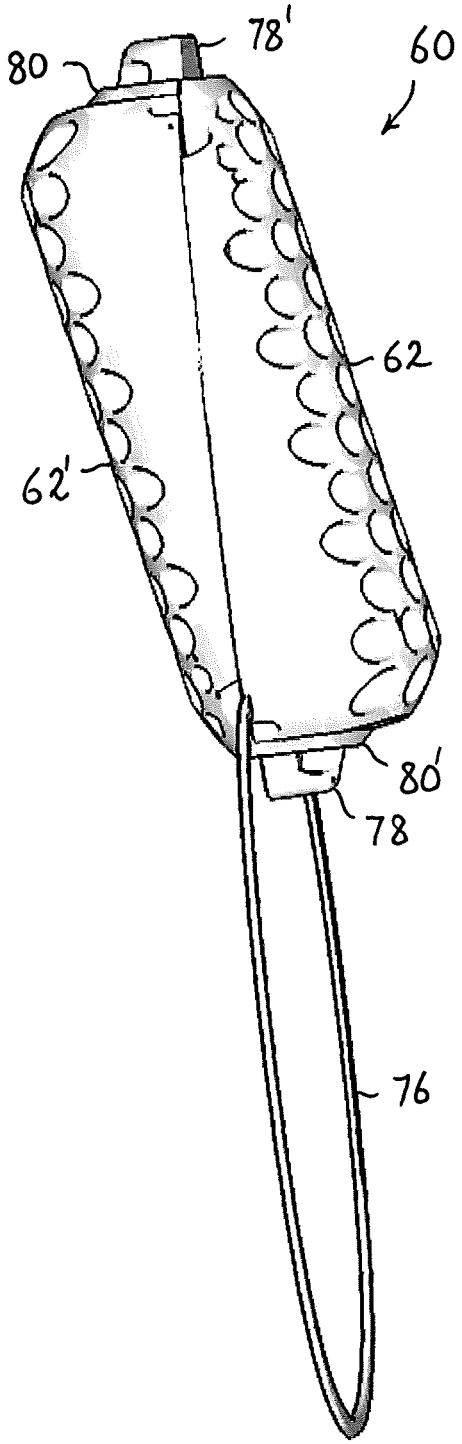
FIG. 11 is a side elevation of the stemming plug as shown in FIG. 9.
Figure 12:
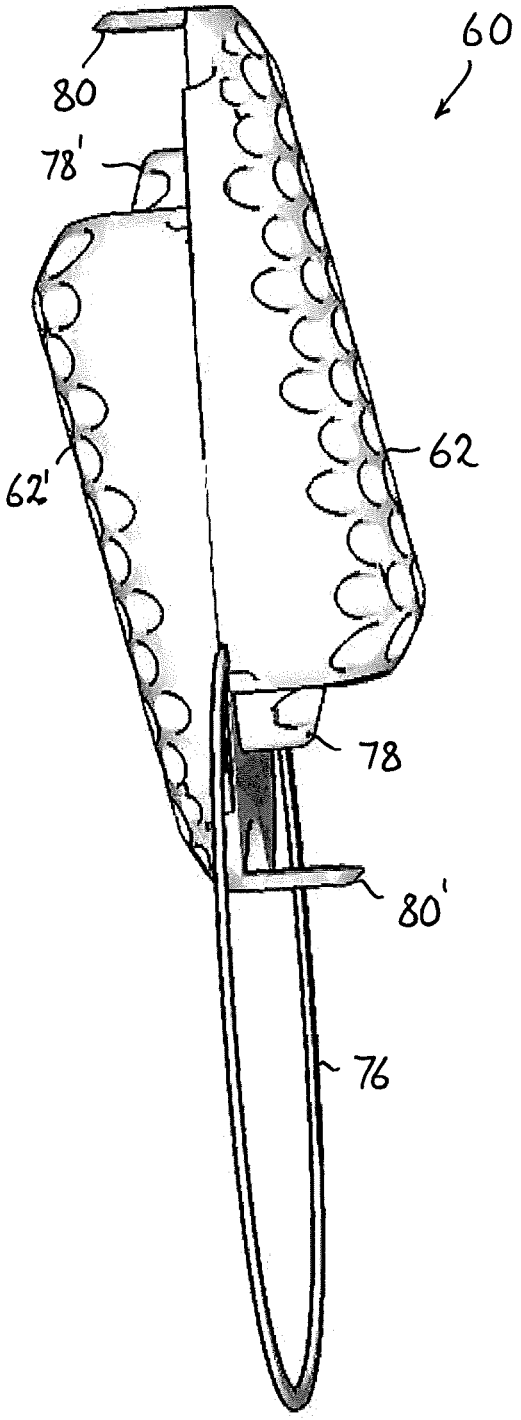
FIG. 12 is a side elevation of the stemming plug as shown in FIG. 10.

Preferably the elongate body of wedge-shaped member 62 is formed with a retention protrusion 78 at one end, and a retention ring 80 at the other end. In use, when the wedge-shaped member 62 is brought into sliding relationship with a matching substantially identical wedge-shaped member, as shown in FIGS. 8 and 9 (see also FIGS. 15 and 16), the retention ring 80 on one wedge-shaped member can engage with the retention protrusion 78 on the other.

Figure 14:
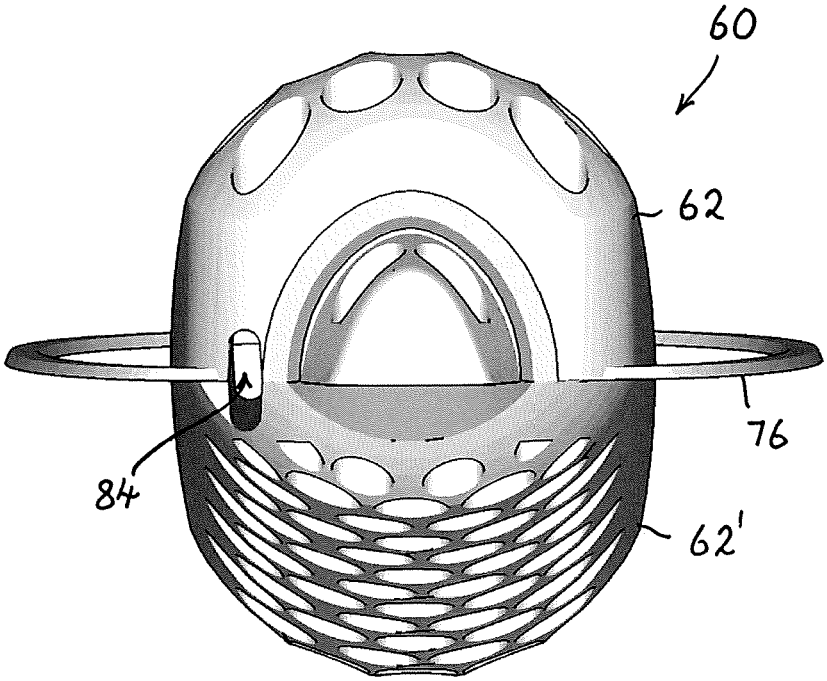
FIG. 14 is a front end elevation of the stemming plug as shown in FIG. 10 showing the detonator lead channel.
Figure 15:
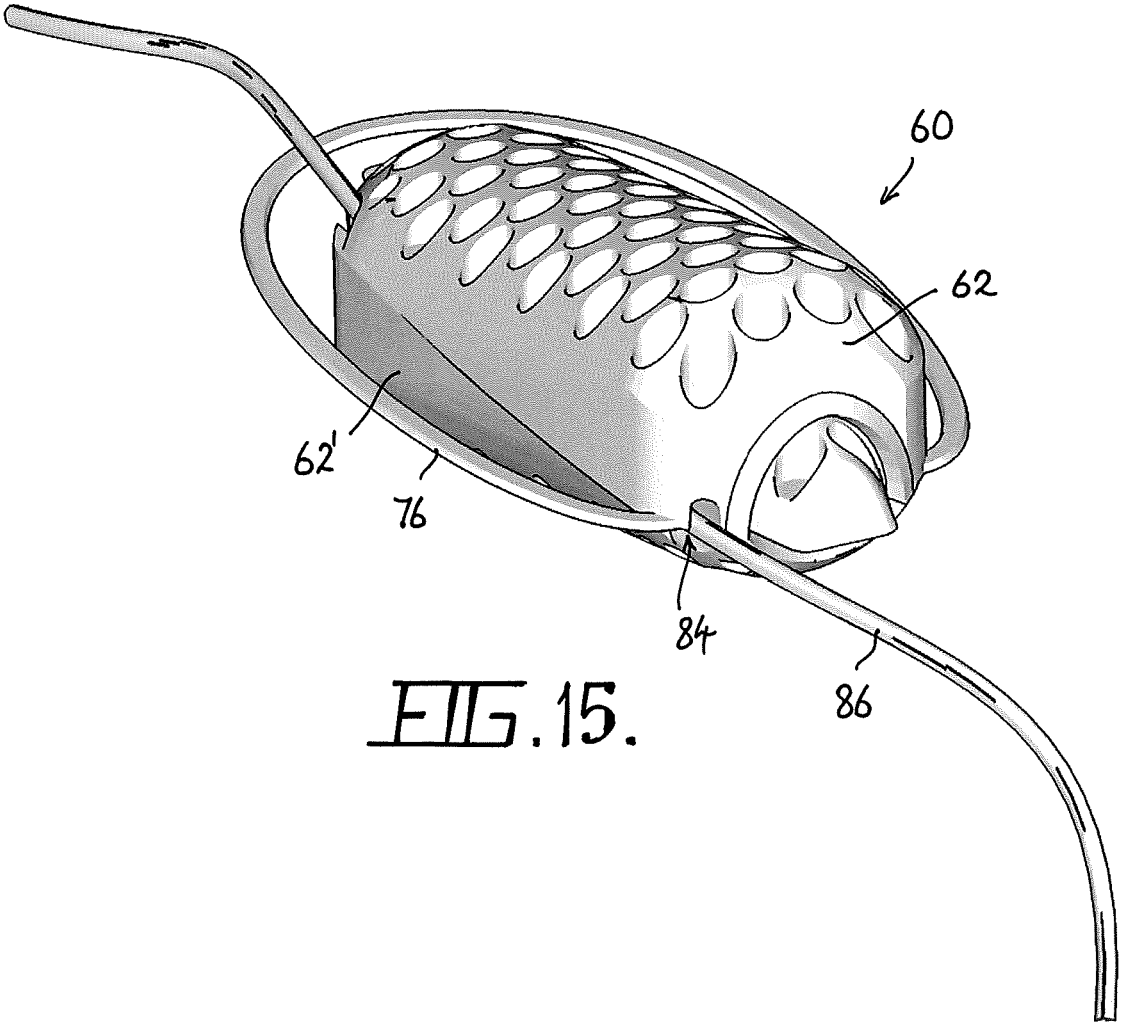
FIG. 15 illustrates in top front perspective view the stemming plug of FIG. 8 with a detonation lead inserted.

Preferably the body of the wedge-shaped member 62 is also provided with a detonator lead channel 84 extending the full length of the body of the wedge-shaped member for receiving a one or more detonator leads 86 prior to installation. Advantageously the detonator lead channel 84 extends along an edge of the substantially planar face 64, as can be seen most clearly in FIG. 7. FIG. 14 is an end view of the stemming plug 60 in which the viewing angle is 12° off the horizontal position i.e. the angle of the sliding plane, showing the detonator channel 84 opening in full in the locked out position. FIGS. 15 and 16 illustrate the stemming plug 60 with the detonator lead 86 received in the channel 84 (the retraction loop 76 has not yet been folded back behind the passive wedge-shaped member 62).

Prior to installation the two halves of the stemming plug 60 separate easily by sliding apart. The detonator lead 86 can be easily inserted and the plug can be closed back on itself containing detonator signal tube or electronic lead. Note that the detonator signal tube or lead has a blasting cap at one end, and a plastic clip at the other and can't just be fed through the channel. It needs to be clipped in sideways. When this is done, the retraction loop 76 may be bent backward for installation either over or under the detonator lead, depending on their relative positions.

Note that a scoop 88, (see FIG. 7) may be included at the front of the wedge-shaped member 62 to provide some additional (i) reduction in area of the passive wedge-shaped member exposed to the blast, and (ii) reduction in area of the active wedge-shaped member exposed to tamping in horizontal holes.

Figure 13:
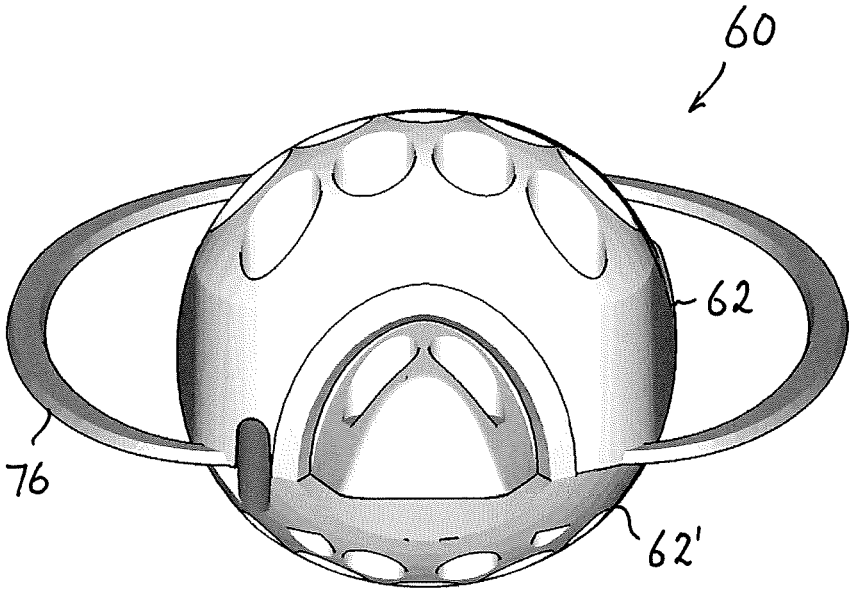
FIG. 13 is a front end elevation of the stemming plug as shown in FIG. 9.

Doubling-up this single component 62 forms a near cylindrical plug 60, as can be seen in FIG. 13, with the following advantageous features:

- A flat sliding contact area
- A profiled, near circular shaped spine, to best provide a contact surface for blast holes of varying diameter.

A protected location for a detonator signal tube

A retention mechanism for holding the plug together during handling and transport A retraction loop 76 that enables the plug to be recovered in case of misfire, with a body shape that ensures both halves are retracted should it be used.

A retraction loop 76 that interferes enough with the hole to retain the placement of the passive wedge-shaped member in the hole, that provides the frictional resistance to movement required, and also a marginal increase in mass for the passive wedge-shaped member.

A retraction loop 76 that connects to the body of passive wedge-shaped member 62 in a geometrically over-centre location. That is, when the plug 60 is received in a blast hole, the connection points of the retraction loop 76 on the body of the passive wedge-shaped member 62 are in the opposite half of a circumference of the hole to the main mass of the passive wedge-shaped member 62 whereby, in use, the over-centre interference of the retraction loop with the wall of the hole actively pushes the wedge-shaped member 62 into its correct position where it rests against the wall of the hole and further allows the active wedge-shaped member 62' to lock in place prior to initiation.

A retraction loop 76 that can be removed easily on the active wedge-shaped member since it cannot perform that function in the orientation of the active wedge-shaped member. However, it can also be left in place and used to assist locating the plug in some circumstances, such as down holes.

A larger surface area of the passive wedge-shaped member 62 facing the operator, which means the plug 60 once pushed into position can be further tamped in place.

A larger surface area of the active wedge-shaped member 62' facing the explosive material.

These features allow the plug to be installed in any orientation:

a) Up holes—the passive wedge-shaped member 62 is retained in the blast hole due to the interference of the retraction loop 76 with the wall of the hole, allowing the active wedge-shaped member to slide down and lock the plug 60 in position in the blast hole after the plug is pushed up to its location.

b) Down holes—if the retraction loop 76' is kept on the active wedge-shaped member 62', it can be used to lock the plug 60 in place when it has been pushed down into a down hole. That is, a rope can be tied around the loop 76' on the active wedge-shaped member 62'. When the plug 60 is pushed down to the location required, then pulling on the rope engages the active wedge-shaped member 62' (for a charge below the plug) or passive wedge-shaped member 62 (for a charge above the plug).

Horizontal holes—the plug relies on gravity to be installed, and should be installed with the active wedge-shaped member 62' towards the toe of the blast hole.

As with the first embodiment, the plug 60 may be installed in the blast hole by an explosives charge hose 90. Preferably the active wedge-shaped member 62' of the plug, which acts as a piston, has the retention ring 80 and scoop 88 provided at a back end, which is sized to allow a threaded end of the explosives charge hose 90 to screw into it. When the plug is in position, the hose is retracted which slides the active wedge-shaped member 62' back toward the collar of the hole and locks it in place against the passive wedge-shaped member 62.

A preferred method of installing the plug 60 will now be described with reference to FIGS. 17 and 18. The plug 60 is installed with the larger surface area of the active wedge-shaped member 62' facing the explosive material. The detonator lead(s) 86 is fed through the channel in the active wedge-shaped member 62'. The two halves 62 and 62' are slid back together ensuring the lead(s) 86 remains in the channel 84 and the retention protrusion 78 at each end of the wedge-shaped members 62 and 62' are in the corresponding retention ring 80 (as shown in FIG. 17). The retraction loop 76 on the passive wedge-shaped member 62 has been folded back so as to protrude from the rear of the stemming plug 60.

The threaded end of a charge hose 90 is inserted into the plug 60, as shown in FIG. 17. The plug 60 is screwed onto the charge hose 90 with several turns of the plug. It is important that the hose 90 is in line with the spine of the plug 60. If it isn't quite lined up, the plug 60 can be bent to the correct position until it clicks into place. The plug 60 is pushed into the blast hole while holding the detonator lead(s) 86. Continue pushing the plug 60 to the final location with the charge hose 90, allowing room for degassing of emulsion.

Retracting the charge hose 90 disconnects and locks out the plug 60 in the blast hole, as shown in FIG. 18. It is now in position for firing. The active wedge-shaped member 62' with its larger end nearest to the explosive material connects to the charge hose 90 more forcefully than the other passive wedge-shaped member 62. Advantageously the retention ring 80' and scoop 88' on the active wedge-shaped member 62' remains in screw-threaded connection with the threaded end of the charge hose 90 as the two wedge-shaped members 62 slide over each other. In this way retraction of the charge hose 90 at an installation location will forcefully lock the two wedge-shaped members 62 in place as the charge hose 90 disconnects from them sequentially, first disconnecting from the passive wedge-shaped member 62 and secondly from the active wedge-shaped member 62' with its larger end nearest to the explosive material as the latter wedge-shaped member locks in the blast hole against the other wedge-shaped member 62.

Figure 19:
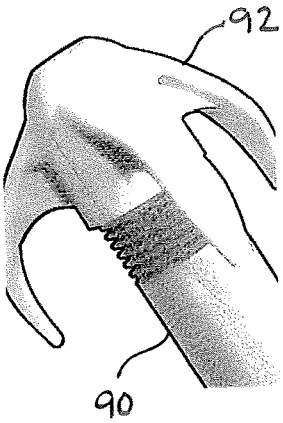

If it is necessary to pull the plug 60 out for a misfire, a retraction hook 92 may be screwed onto the end of the charge hose 90 (see FIG. 19). The hook 92 is used to hook onto the retraction loop 76 and withdraw the plug 60. If it is necessary to push the plug 60 further into the blast hole, the plug should be withdrawn completely using the hook 92, and the installation process repeated. The stemming plug 60 can be re-installed several times if necessary until fired upon.

The single component design lends itself to relatively inexpensive manufacture through injection moulding of one single part. However, there are critical requirements for the material to be used. Generally a thermoplastic, as is commonly used for injection moulding, would be suitable, subject to the following requirements:

It is flexible enough for the retraction loop to be folded back and forced in shear against the wall of the drill hole, It is strong enough to wedge forcefully against the other wedge-shaped member and also for the retraction loop to retain enough strength to retract the plug should it be required prior to blasting, and It is strong enough to provide resistance in this geometry to the blast being initiated.

Alternatively there are injection moulding techniques that allow the use of a single mould for manufacture of identical wedge component bodies, and also allow the addition of the retraction loop as a separate component using an additional process that can be used with the mould. For example, a loop of nylon cord could be added in to the mould during the moulding process and therefore become part of that wedge. In this way, the retraction loop can be added or not added during manufacture as required.

Now that several embodiments of the improved stemming plug have been described in detail, it will be apparent that the described embodiments provide a number of advantages over the prior art, including the following:

(i) They lend themselves to mass-production, and therefore can be manufactured more rapidly and cost-effectively.

(ii) They are simple to use and place in a blast hole.

(iii) They are easily retractable from the blast hole in case of misfire.

iv) They are made of a material that is lightweight, durable, inert and strong.

(v) They are self-locking on installation.

(vi) They can be assembled from a pair of substantially identical wedge-shaped members, thus significantly simplifying and reducing the manufacturing process.

It will be readily apparent to persons skilled in the relevant arts that various modifications and improvements may be made to the foregoing embodiments, in addition to those already described, without departing from the basic inventive concepts of the present invention. For example, the coring in the body of the wedge-shaped member may take any shape or form, and not need be in the form of the coring apertures of the illustrated embodiment. Therefore, it will be appreciated that the scope of the invention is not limited to the specific embodiments described.

The invention claimed is:

1. A stemming plug for stemming a blast hole in a mine, the plug comprising:

first and second elongate wedge-shaped members manufactured from a suitable plastics material;

the first wedge-shaped member having a larger end with a face sloping towards a smaller end, the sloping face being received in sliding relationship with a matching face of the second wedge-shaped member wherein, in use, when the first wedge-shaped member is positioned with its larger end nearest to an explosive material in the blast hole it has a larger surface area facing the explosive material than the second wedge-shaped member; and, wherein the second wedge-shaped member is provided with a retraction loop for retracting the plug from the blast hole after installation in a case of misfire, and wherein the retraction loop interferes enough with the blast hole to retain the placement of the second wedge-shaped member in the hole, and provides the frictional resistance to movement required, as well as a marginal increase in mass for the second wedge-shaped member;

whereby, in use, when a shockwave from initiation of the explosive material in the blast hole encounters the first wedge-shaped member it acts as a piston, sliding on the second wedge-shaped member so that both wedge-shaped members exert diametrically opposed forces against the wall of the blast hole to lock the plug in place.

2. A stemming plug as defined in claim 1, wherein the retraction loop connects to a body of the second wedge-shaped member in a geometrically over-centre location, that is, when the plug is received in a blast hole, the connection points of the retraction loop on body of the second wedge-shaped member are in the opposite half of a circumference of the hole to the main mass of the second wedge-shaped member, so that it actively pushes the wedge-shaped member into a position where it rests against the side of the hole and further allows the first wedge-shaped member to lock in place prior to initiation.

3. A stemming plug used for stemming a blast hole in a mine, the plug comprising:

a pair of substantially identical elongate wedge-shaped members manufactured from a suitable plastics material;

each wedge-shaped member having a larger end with a substantially planar face sloping towards a smaller end, the sloping face being adapted to be received in sliding relationship with a matching face of the other wedge-shaped member wherein, in use, the two wedge-shaped members can be positioned in the blast hole in sliding relationship, with an active wedge-shaped member with its larger end nearest to an explosive material in the blast hole having a larger surface area facing the explosive material than the other passive wedge-shaped member;

wherein at least one of the wedge-shaped members is provided with a retraction loop for retracting the plug from the blast hole after installation in a case of misfire, and the retraction loop interferes enough with the blast hole to retain the placement of the passive wedge-shaped member in the hole, and provides the frictional resistance to movement required, as well as a marginal increase in mass for the passive wedge-shaped member;

whereby, in use, when a shockwave from initiation of the explosive material in the blast hole encounters the active wedge-shaped member it acts as a piston, sliding on the other passive wedge-shaped member so that both wedge-shaped members exert diametrically opposed forces against the wall of the blast hole to lock the plug in place.

4. A stemming plug as defined in claim 3, wherein the retraction loop connects to a body of the wedge-shaped member in a geometrically over-centre location, that is, when the plug is received in a blast hole, the connection points of the retraction loop on a body of the passive wedge-shaped member are in the opposite half of a circumference of the hole to the main mass of the passive wedge-shaped member, so that it actively pushes the wedge-shaped member into a position where it rests against the side of the hole and further allows the active wedge-shaped member to lock in place prior to initiation.

5. A stemming plug as defined in claim 3, wherein a body of each wedge-shaped member is formed with a retention protrusion at one end, and a retention ring at the other end wherein, in use, when one wedge-shaped member is brought into sliding relationship with the other wedge-shaped member the retention ring on one wedge-shaped member can engage with the retention protrusion on the other.

6. A stemming plug as defined in claim 3, wherein a body of each wedge-shaped member is also provided with a detonator lead channel extending the full length of the body of the wedge-shaped member for receiving a detonator lead prior to installation.

7. A stemming plug as defined in claim 6, wherein the detonator lead channel extends along an edge of the substantially planar face of the wedge-shaped member.

8. A stemming plug as defined in claim 3, wherein each wedge-shaped member is formed with an elongate body having the substantially planar face on one side of the body and a profiled surface on the opposite side of the body which is adapted to engage with a wall of the blast hole.

9. A stemming plug as defined in claim 8, wherein the body of the wedge-shaped member is provided with a plurality of coring apertures to reduce the thickness of the plastics material in the body of the wedge-shaped member.

10. A stemming plug as defined in claim 9, wherein the coring apertures are provided in the profiled surface.

11. A stemming plug as defined in claim 8, wherein the two wedge-shaped members when joined together form a near cylindrical plug with a profiled, near circular shaped spine, to best provide a contact surface for blast holes of varying diameter.

* * * * *